United States Patent [19]

Salam

[11] Patent Number: 4,819,357

[45] Date of Patent: Apr. 11, 1989

[54] INFORMATION DISPLAY DEVICES

[76] Inventor: Hassan P. A. Salam, 63 Lowther Rd., Barnes, London SW13, England

[21] Appl. No.: 737,041

[22] Filed: May 23, 1985

Related U.S. Application Data

[63] Continuation-in-part of Ser. No. 459,223, Jan. 19, 1983, abandoned.

[30] Foreign Application Priority Data

Jan. 22, 1982 [GB] United Kingdom ..... 8201779
May 23, 1984 [GB] United Kingdom ..... 8413139

[51] Int. Cl.[4] ..... G09F 9/00

[52] U.S. Cl. ..... 40/449; 40/446; 40/463; 340/763; 340/815.05; 340/815.27; 340/783

[58] Field of Search ..... 40/447, 446, 449, 448, 40/463; 340/764, 783, 815.04, 815.05, 815.26, 815.27, 815.29, 815.24

[56] References Cited

U.S. PATENT DOCUMENTS

| | | | |
|---|---|---|---|
| 1,796,030 | 3/1931 | Kell | 340/764 |
| 3,140,553 | 7/1964 | Taylor | 40/449 |
| 3,266,033 | 8/1966 | Frohbach | 340/764 |
| 3,283,427 | 11/1966 | Winrow | 40/449 |
| 3,295,238 | 1/1967 | Winrow | 40/449 |
| 3,304,549 | 2/1967 | Aiken | 40/447 |
| 3,365,824 | 1/1968 | Winrow | 40/463 |
| 3,451,055 | 6/1969 | Pihl | 340/815.26 |
| 3,469,258 | 9/1969 | Winrow | 40/449 |
| 3,624,941 | 12/1971 | Chantry | 40/463 |
| 3,680,083 | 7/1972 | Pihl | 340/764 |
| 3,745,563 | 7/1973 | Jones et al. | 40/447 |
| 3,775,881 | 12/1973 | Salam | 40/449 |
| 3,991,496 | 11/1976 | Helwig et al. | 40/449 |
| 4,015,255 | 3/1977 | Wood | 340/815.27 |
| 4,163,332 | 8/1979 | Salam | 40/449 |
| 4,243,978 | 1/1981 | Winrow | 340/815.26 |
| 4,380,879 | 4/1983 | Seibert | 40/447 |

FOREIGN PATENT DOCUMENTS

| | | | |
|---|---|---|---|
| 18286 | of 1911 | United Kingdom | 40/449 |
| 941696 | 11/1963 | United Kingdom | 40/449 |

*Primary Examiner*—Gene Mangene
*Assistant Examiner*—J. Hakomaki
*Attorney, Agent, or Firm*—Laubscher & Laubscher

[57] ABSTRACT

A display device of the matrix type utilizes coincident current selection of display elements by the provision of row conductors (R) activating row electromagnets (D) and column conductors (C) activating column electromagnets (H). Each display element includes a rotatable vane (S) which is stable in open and closed positions and a permanent magnet (M) co-operates with the electromagnet (D) to urge the vane (S) into the appropriate position.

A clutch member in the form of a bar (L) extending from the vane (S) contacts the pole face of an electromagnetic (H) which, when activated, serves to inhibit movement of the vane irrespective of activation of the row electromagnet (D). Thus by pulsing the display row-by-row, the state of the display elements can be set by selective inhibiting of movement in coincident manner of the appropriate vanes (S) by pulsing the respective column conductors.

5 Claims, 4 Drawing Sheets

FIG. 7
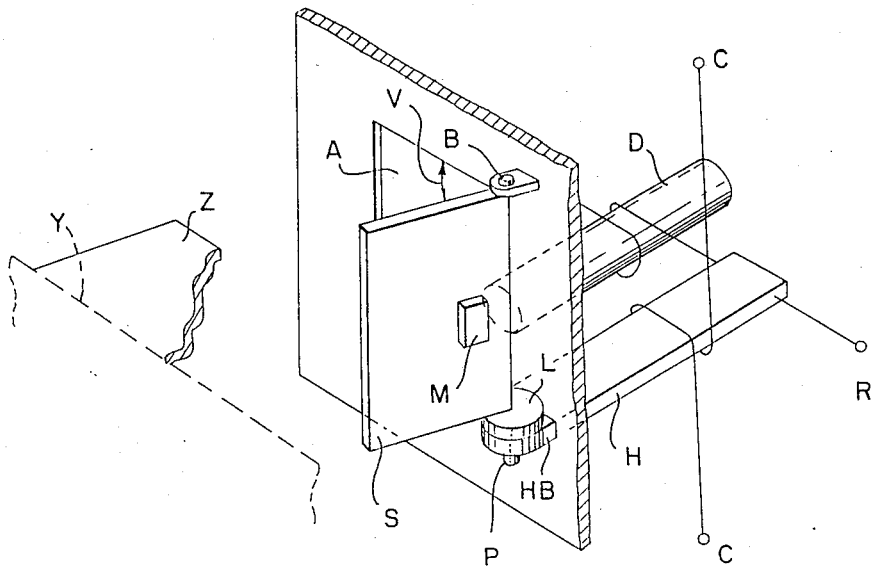
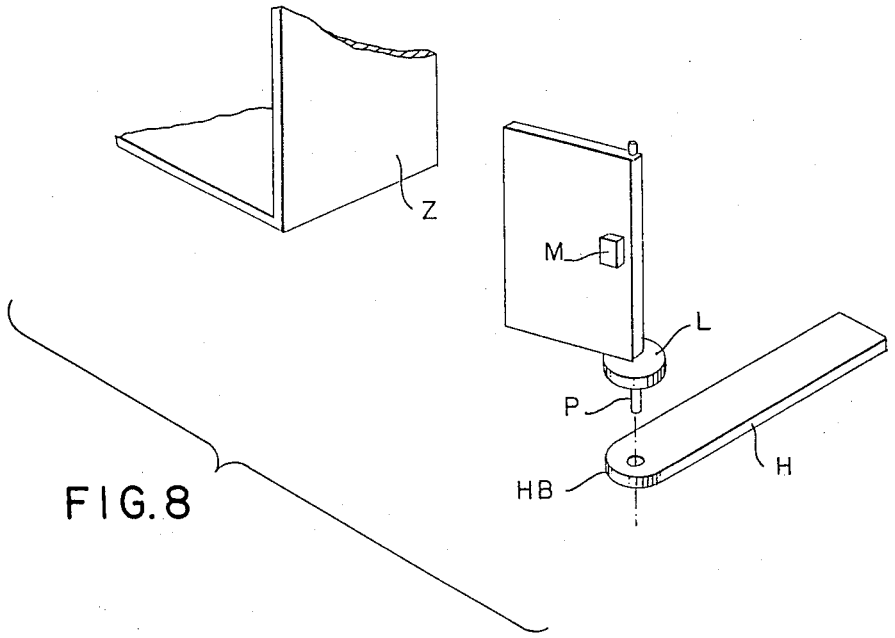
FIG. 8

INFORMATION DISPLAY DEVICES

This is a continuation-in-part of application Ser. No. 459,223, filed Jan. 19, 1983, now abandoned.

BACKGROUND OF THE INVENTION

This invention relates to information display devices of the type in which each display element in the complete display includes a hinged member and an electromagnet which interacts with a permanent magnet on the hinged member.

BRIEF DESCRIPTION OF THE PRIOR ART

Displays of this type include those described in U.S. Pat. Nos. 4,163,332 and 4,140,553 which specifically relate to displays including a matrix of display elements.

Another known display matrix, using a technique known as Coincident Current selection, is described in U.S. Pat. No. 3,469,258. With this arrangement, there is provided a single winding conductor for each row of the matrix and similarly one for each column. Writing on the matrix can be carried out row-by-row or column-by-column. With row-by-row writing, for example, each row conductor is energized in turn to select the row, and coincidentally selected column conductors are energized, corresponding to the required pattern of dots to be written onto the row. Since only one row is energized at a time, the main drive power for altering the display elements is in the column drives. For many patterns, all or nearly all the columns must be driven simultaneously. In the arrangement in U.S. Pat. No. 3,469,258, each column conductor must be driven so as to apply to each of its associated display elements one half of the power needed to alter the state of the display element. The arrangement actuates each display element by the use of an individual electromagnet having a core of square loop magnetic material that is permanently magnetizable. It therefore requires a large amount of power to actuate the matrix, since for a change of element state, the magnetization must be reversed along the square hysteresis loop.

U.S. Pat. No. 3,775,881 describes other display matrices using hinged display elements with coincident current selection. These require orthogonal fields for their operation, and they rely on hollow windings inside which the display elements and their armatures move. They require more current to operate than do the arrangements in U.S. Pat. No. 3,469,258, partly because the magnetic flux generated by the windings is dispersed over a large volume of space, instead of being directed by a ferromagnetic part to the permanent magnet. Another disadvantage is that they are difficult to maintain because the moving display elements and their actuators are embedded in the windings.

SUMMARY OF THE INVENTION

A general object of the present invention is to overcome the disadvantages of the previous proposals. It is therefore one object of the present invention to provide a coincident current display matrix in which the current drive requirements and, therefore, the costs of the drive circuits, are reduced relative to the known arrangements. A further object is to provide display matrices in which the display elements can be individually selectively set to any one of several different optical states.

The present invention has an advantage compared with the arrangements in U.S. Pat. No. 3,469,258 in that the electromagnet for actuating the display element via its permanent magnet uses a core of soft ferromagnetic material. This core requires less than a quarter of the power that would otherwise be needed to magnetize if it were of square loop material. This is because the permeability of the soft core material is appreciably greater than that of the square loop material, resulting in less ampere-turns being needed to produce the same magnetic flux. Also the drive power applied through a column conductor to each of its display elements can readily be made less than one fifteenth of the power needed to alter the state of the display element. Taking the two factors into account, the column drive power is reduced by a factor of 30 compared to the previous arrangement described in U.S. Pat. No. 3,469,258. The very low column drive power requirement is achieved in the preferred embodiment by using a simple but very sensitive inhibitor arrangement in each display element, actuated by the column current.

The sensitive inhibitor relies on the fact that the force needed to separate or shift relative to each other two magnetized parts of ferromagnetic material that are in contact with each other is very high compared, for example, with the interactive force between similar parts that are separated by an air gap.

Because of the reduction of column power, the present invention enables matrices to be constructed having 30 times more rows without increasing the cost of column drivers relative to known arrangements. This facilitates the economical construction of large display matrices capable of displaying pictures with fine detail.

Yet another advantage of the present invention is that it can be arranged to provide a coincident current matrix with grey-scale capability, i.e. the capability of finely adjusting the brilliance of each display element individually. The recited prior art lacks this capability.

BRIEF DESCRIPTION OF THE FIGURES

In order that the present invention may be more readily understood, embodiments thereof will now be described, by way of example, with reference to the accompanying drawings, in which:

FIG. 7 shows a perspective view of a part of an alternative matrix display element; and FIG. 8 shows an exploded perspective view of a part of the display element shown in FIG. 7.

DETAILED DESCRIPTION

Figure 1:
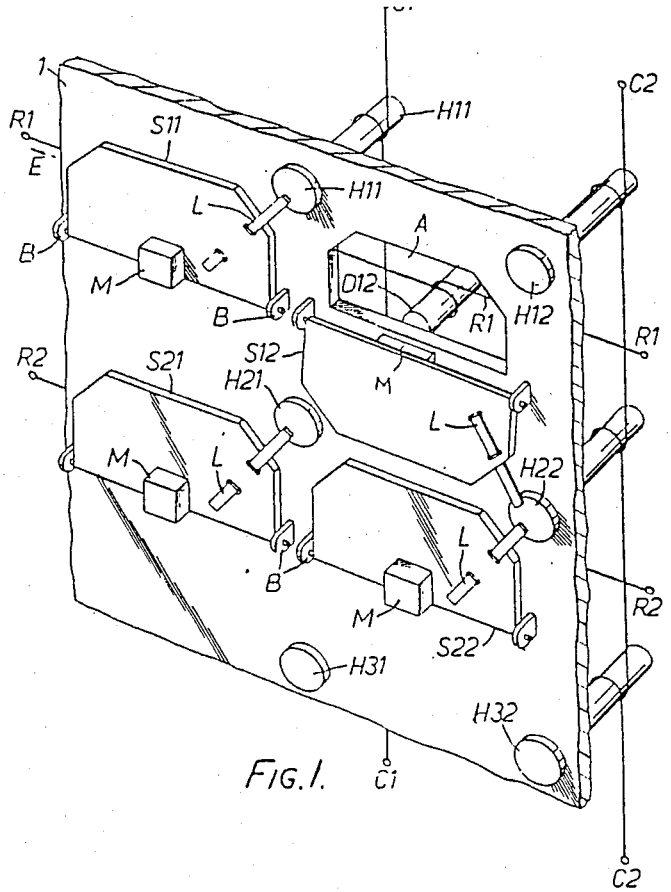
FIG. 1 shows a front perspective view of part of a matrix display in accordance with one embodiment of the invention.

Referring to FIG. 1, there is shown a portion of a display matrix, the portion having two rows and two columns of display elements. Associated with each row there is a row conductor R and with each column a column conductor C. These designations are followed by a number to indicate the row and the column positions. The display elements share a common opaque base plate 1 having apertures A therein and are optically of the type described in U.S. Pat. No. 4,163,332 from which further constructional details may be derived. Each element includes a vane S mounted with the aid of hinge brackets B attached to base plate 1 to rotate about a horizontal axis between a first stable position in which it covers aperture A and a second position in which it uncovers the aperture, for example so as to allow light from a source, not shown, behind panel 1 to pass through to the viewer, as illustrated for vane S12 in row 1, column 2. Alternatively, or in addition to the light source, the opposite faces of each vane may present contrasting appearances, such as different colours. Each vane S carries a permanent magnet M having a magnetic axis normal to the plane of the vane and a member L of magnetic material of low remanence protruding out beyond an edge of the vane. Each display element also includes a first electromagnet pole D attached to panel 1 by means not shown placed near to the zone of the magnet M and a second electromagnet pole H mounted so as to be in contact with or very close to the tip of the protruding portion of bar L, when the vane covers the aperture. The polarity of magnet M is chosen so that when pole d is energized by current in the direction of arrow E, the vane is urged into the aperture covering position.

Figure 2:
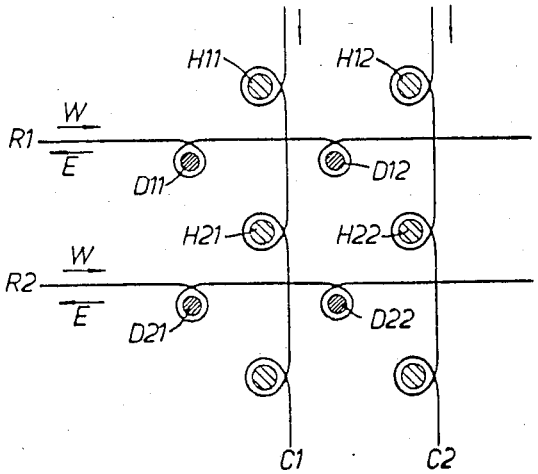
FIG. 2 shows the wiring scheme of the coils of the display shown in FIG. 1.

As shown in FIG. 2, for each row, conductor R is wound round each pole D in the row in turn and, for each column, conductor C is wound round each pole H in the column in turn.

A method of operating this matrix is as follows. Firstly, the matrix is blanked by pulsing all rows R simultaneously with currents in the direction of arrow E. The apertures are thus all covered. Next, each row conductor R in turn is pulsed with current in the direction of arrow W. At the same time as a row conductor is pulsed, column conductors C are pulsed for those column positions where it is required that the display elements in the row remain light blocking. The effect of passing current through conductor C is to magnetize hold poles H of the column, causing them in turn to magnetize and clutch their associated bar members L. The force needed to separate each magnetized bar member from its associated hold pole is large even if the column current is small, because there is negligible air gap between the two magnetized parts. The effect of pulsing a row conductor R in the direction of arrow W is to urge the vanes S into the aperture exposing position. The current in each selected column conductor C is made sufficiently large to ensure that the vane S is held closed with a torque greater than that induced in the vane by energising its electromagnet D. The current in the selected row conductor is made sufficiently large to ensure that the vanes S that are associated with it and that are not in energized column positions are switched to the aperture exposing position.

With the arrangement in FIG. 1, suppression of rotation of vanes S is possible for both blanking and writing, since for both vane positions bar element L is in contact with a pole H. This feature is useful under certain conditions, for example when the matrix is used to show the time of day digitally. In this case those digits that change from minute to minute are blanked prior to updating the time. The remaining digits are left undisturbed.

Figure 3:
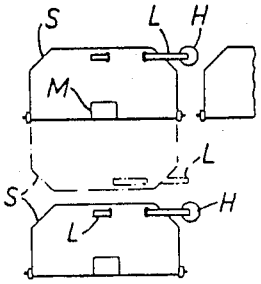
FIG. 3 shows adjacent display elements of a second embodiment of the invention.

FIG. 3 illustrates how the arrangement of FIG. 1 can be modified so that poles H can hold the vanes only when they are in the aperture covering position. The holding poles H for each row are placed lower than half way between the hinge axis of the row and that of the next row down, and bar L is placed on the vane S so that it protrudes sideways. With the vane in the aperture exposing position, bar L is spaced away from pole H. With this modified arrangement, it is possible to blank the matrix row by row and to write on each row i.e. expose selected apertures, as the row below it is being blanked.

Figure 4:
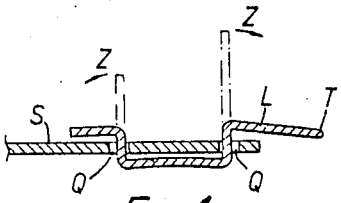
FIG. 4 shows a manner of assembly of a display element part.

In the arrangements of FIG. 1 and 3, bar L is preferably arranged so that its portion that comes in contact with pole H is free to move to a limited extent relative to the vane S in a directional normal to that of the vane surface. This is to ensure that when the vane is in the aperture blocking position it is in contact at its top with base plate 1 and at the same time bar L is in contact with pole H, regardless of small variations in the dimensions of the parts. A way of achieving the desired limited degree of movement is illustrated in FIG. 4, which is a cross-sectional view of a portion of vane S with the section taken through the longitudinal axis of bar L. Holes Q are provided in vane S. Bar L is initially U-shaped as indicated by the dotted lines and is inserted through holes Q prior to bending in the directions indicated by arrows Z. The lengths of the short portions sliding in aperture Q are chosen to give the desired freedom of motion.

Figure 5:
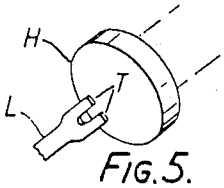
FIG. 5 shows a modification of the display element part shown in FIG. 4.

FIG. 5 shows a modified arrangement of bar L in which the end portion T is bifurcated. Because of the loose mounting of bar L through holes Q, bar L is free to rotate slightly about its longitudinal axis. Thus, a snall portion of grit lodged between one of the prongs of end portion T and the face of pole H will not prevent contact between bar L and pole H, as the other prong is free to come into contact.

Figure 6:
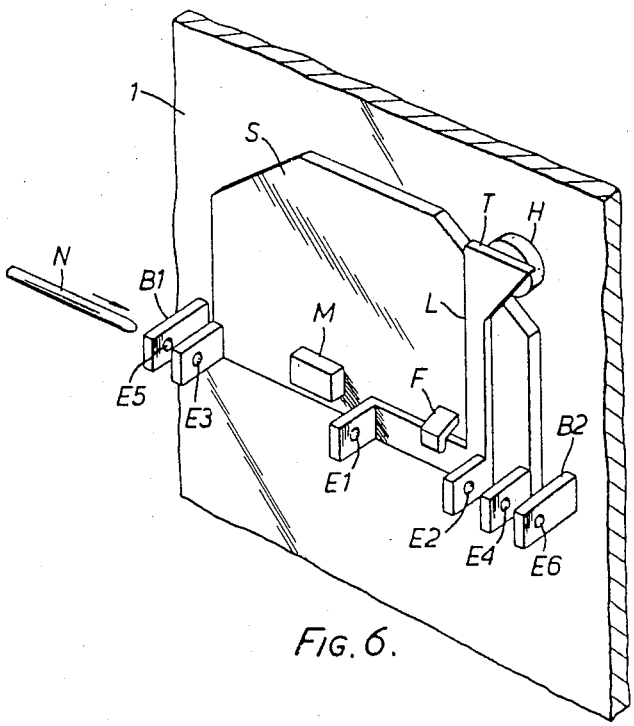
FIG. 6 shows one display element of a further embodiment of the invention.

FIG. 6 shows another arrangement of vane S and holding bar L. Bar L is pressed out of soft iron or nickel-iron permalloy and is formed to have two bearing eyelets E1, E2. Vane S is also provided with bearing eyelets E3, E4. Brackets B1, B2 attached to base plate 1 have further eyelets E5,E6. A bearing rod N is threaded through all six eyelets and it may be common to several display elements in a row. Vane S includes an angle bracket portion F that retains bar L in position on vane S but allows it to rotate slightly relative to the vane, about the same axis as the vane itself rotates. Tip portion T of the bar L can come into contact with holding pole H and is arranged to be flared out so that it presents to pole H a contact surface of large area. This results in a strong attraction between the two when pole H is magnetized, even if there are particles of grit trapped between tip T and pole H.

It is important to arrange that clutch arrangement H,L is not magnetized by stray fields from magnets M or from magnetized poles D, otherwise rotation will be suppressed even if there is no column current. For this reason poles H should be adequately separated or else magnetically screened from poles D and member L on vane V should be spaced away both from magnet M and pole D.

FIG. 7 shows an alternative arrangement for the display element. As before, a vane S is caused to cover or uncover a back illuminated aperture A by appropriate energization of row conductor R. This energization magnetizes pole D of ferromagnetic material of low remanence which acts on magnet M as previously described. As before, a hold pole H of ferromagnetic material of low remanence can be magnetized by energizing column conductor C so as to attract ferromagnetic member L of material of low remanence attached to vane S, to stop rotation of vane S. In this arrangement member L is cylindrical and is in contact with a portion HB of hold pole H for all rotational positions of vane S. As illustrated in the exploded view in FIG. 8 member L includes a bearing pin P which bears in a hole in portion HB. This arrangement can be used to stop rotation of vane S in any position between the fully open and fully closed positions, thus providing fine adjustment of the amount of light passing through the aperture. The display element can include a diffuser Y placed between vane S and the observer, to allow the display to be viewed from a wide range of positions.

The diffuser Y may be mounted on a framework of partitions Z extending normal to the plane of the display and separating the display elements one from another. The partitions are made reflective in order to direct light from the variable aperture on to the diffuser Y.

After blanking the matrix, a vane S in a given row and column position is set to the desired angle V to pass the required amount of light by energizing the row conductor to urge the vane to open. At the instant when vane S has rotated to the required angle V conductor C is energized causing member L to be strongly attracted to hold pole H thus stopping rotation. This energization of conductor C is maintained until energization of conductor R is terminated. A whole row of display elements can be set simultaneously, setting the timing of each column current in accordance with the amount of light required in the column position.

As an alternative, cylindrical member L can be a permanent magnet magnetized along its axis of rotation. In the absence of current in conductor C member L magnetizes hold pole H and the two are clutched together preventing rotation of vane S when conductor R is energized. To open the vane to a desired angle V conductor R is energized and, starting at the same time, conductor C is energized so that pole H slightly repels member L, thus considerably reducing or eliminating the force with which member L bears on pole H, thus allowing rotation. When the vane has reached the required angle V, the current in conductor C is terminated, causing pole H to attract member L thus stopping rotation.

I claim:

1. A display matrix, comprising (a) a generally planar support (1) containing a plurality of display elements;

(b) a plurality of display members (S) rotatably connected with said support associated with said display elements, respectively, said display members being rotatable between first and second positions to alter the appearance of the display elements;

(c) a plurality of permanent magnets (M) connected with said display members, respectively;

(d) first ferromagnetic members (L) connected with said display members, respectively, in spaced relation from said permanent magnets;

(e) actuating means connected with said support for rotating said display members between said first and second positions, said actuating means including (1) second ferromagnetic members (D) arranged adjacent said permanent magnets, respectively, at least when said display members are in said first positions; and (2) first coil means (R) connected with a group of said second ferromagnetic members to magnetize said group of second ferromagnetic members upon energization of said first coil means to urge rotation of a group of adjacent display members by interaction with the adjacent permanent magnets; and (f) current controlled holding means connected with said support for selectively retaining display members against rotation in response to said actuating means, said holding means including (1) third ferromagnetic members (H) connected with said support and arranged adjacent said first ferromagnetic members, respectively, at least when said display members are in said first position; and (2) second coil means (C) connected with a set of said third ferromagnetic members arranged so that selective predetermined energization of said second coil means prevents, by interaction between said set of third ferromagnetic members and adjacent first ferromagnetic members, rotation of selected display members of said group that are urged to rotate by energization of said first coil means.

2. A display matrix as defined in claim 1, wherein said first, second and third ferromagnetic members are of ferromagnetic material of low remanence.

3. A display matrix as defined in claim 1, wherein said first ferromagnetic members are permanent magnets.

4. A display matrix as defined in claim 1, wherein at least one of said first and second coil means comprises several coils spaced apart from each other and connected in series and wherein for each display element said first and third ferromagnetic members are arranged close to each other when the display member is in said first position and remote from each other when the display member is in said second position.

5. A display matrix as defined in claim 4, wherein said first and third ferromagnetic members are of ferromagnetic material of low remanence.

* * * * *